US005588308A

United States Patent [19]

Daugherty et al.

[11] Patent Number: 5,588,308

[45] Date of Patent: Dec. 31, 1996

[54] RECOMPRESSION CYCLE FOR RECOVERY OF NATURAL GAS LIQUIDS

[75] Inventors: Tamara L. Daugherty, Allentown; Christopher F. Harris, Old Zionsville, both of Pa.

[73] Assignee: Air Products And Chemicals, Inc., Allentown, Pa.

[21] Appl. No.: 517,524

[22] Filed: Aug. 21, 1995

[51] Int. Cl.[6] ..... F25J 3/02

[52] U.S. Cl. ..... 62/622; 62/630

[58] Field of Search ..... 62/622, 630

[56] References Cited

U.S. PATENT DOCUMENTS

| | | | |
|---|---|---|---|
| 3,119,677 | 1/1964 | Moon et al. | 62/622 |
| 4,217,759 | 8/1980 | Shenoy | 62/622 |
| 4,666,483 | 5/1987 | Gauthier | 62/622 |
| 4,676,812 | 6/1987 | Kummann | 62/622 |
| 4,746,342 | 5/1988 | DeLong et al. | 62/630 X |
| 4,966,612 | 10/1990 | Baver | 62/622 |
| 5,041,149 | 8/1991 | Handley | 62/622 |

OTHER PUBLICATIONS

Collins, C. et al, "Trends in NGL Recovery from Natural and Associated Gases", Gastech LNG/LPG Conference 84, Published by Gastech Ltd., Rickmansworth, England, pp. 287–803.

Mackenzie, D. H., Connely, D. T., "Mixed Refrigerants Proven Efficient in Natural–Gas–Liquids Recovery Process", in *Oil and Gas Journal*, Mar. 4, 1985, pp. 116–120.

Wilkinson, J. D., Hudson, H. M., "Improved NGL Recovery Designs Maximize Operating Flexibility and Product Recoveries" in the *Proceedings of the 71st GPA Annual Convention.*

*Primary Examiner*—Christopher Kilner

*Attorney, Agent, or Firm*—John M. Fernbacher

[57] ABSTRACT

Natural gas liquids (NGLs) are recovered by cooling and partial condensation of a purified natural gas feed wherein a portion of the necessary feed cooling and condensation duty is provided by expansion and vaporization of condensed feed liquid after methane stripping, thereby yielding a vaporized NGL product. Additional refrigeration for feed cooling is provided by vaporizing methane-stripped liquid, which in turn provides vapor boilup for the stripping step. Recompression and cooling of the vaporized NGL product can be utilized if a liquid product is required.

11 Claims, 2 Drawing Sheets

RECOMPRESSION CYCLE FOR RECOVERY OF NATURAL GAS LIQUIDS

FIELD OF THE INVENTION

The present invention is directed towards the recovery of hydrocarbon liquids from natural gas and in particular to an improved process cycle for such recovery.

BACKGROUND OF THE INVENTION

Natural gas typically contains up to 15 vol % of hydrocarbons heavier than methane which are separated to provide pipeline quality methane and recovered liquid hydrocarbons. These valuable natural gas liquids comprise primarily ethane, propane, butane, and minor amounts of other light hydrocarbons which are recovered from natural gas following compression and initial removal of nonhydrocarbon acid gases, water, and other impurities.

Natural gas liquids (NGLs) are recovered from compressed prepurified natural gas by well-known methods including absorption, refrigerated absorption, adsorption, and condensation at cryogenic temperatures down to about −175° F. Refrigeration for low temperature recovery processes is commonly provided by external refrigeration systems using ethane or propane as refrigerants; mixed refrigerants and cascade refrigeration cycles are used in some applications. Refrigeration also is provided by turboexpansion or work expansion of the compressed natural gas feed with appropriate integral heat exchange.

A general review of NGL recovery methods is given by C. Collins, R. J. J. Chen, and D. G. Elliot in a paper entitled "Trends in NGL Recovery from Natural and Associated Gases" in Gastech, Gastech LNG/LPG Conference 84, Published by Gastech Ltd., Rickmansworth, England, pp. 287–303. The use of mixed refrigerants in NGL recovery is reviewed in a paper entitled "Mixed Refrigerants Proven Efficient in Natural-Gas-Liquids Recovery Process" by D. H. MacKenzie and D. T. Connely in *Oil and Gas Journal*, Mar. 4, 1985, pp. 116–120. J. D. Wilkinson and H. M. Hudson disclose turboexpander cycles for NGL recovery in a paper entitled "Improved NGL Recovery Designs Maximize Operating Flexibility and Product Recoveries" in the *Proceedings of the 71st GPA Annual Convention*. Refrigeration for NGL recovery by these well-known methods is provided either by external refrigeration or by work expansion of the compressed natural gas feed.

An alternative and improved method for NGL recovery which does not require external refrigeration or work expansion of the feed gas has been developed in the present invention as described in the specification below and defined in the claims which follow.

SUMMARY OF THE INVENTION

The invention is a method for the recovery of hydrocarbons heavier than methane from mixtures of methane and heavier hydrocarbons which comprises cooling and partially liquefying a compressed natural gas feed stream containing methane and heavier hydrocarbons, and separating the resulting partially condensed feed stream into a methane-rich vapor and a first liquid. The first liquid is introduced into a stripping column which operates at or below the pressure of the partially condensed feed stream, and a methane-rich overhead vapor and a stripper bottoms liquid rich in hydrocarbons heavier than methane are withdrawn from the stripping column. The stripper bottoms liquid is expanded and the resulting expanded stream is vaporized by indirect heat exchange with the compressed natural gas feed stream, thereby providing at least a portion of the cooling for the compressed natural gas feed stream and yielding a vaporized stripper bottoms stream rich in hydrocarbons heavier than methane.

The stripping column optionally operates below the pressure of the partially condensed feed stream, and the first liquid is expanded and thereby cooled prior to introduction into the stripping column. Another portion of the cooling of the compressed natural gas feed stream optionally is provided by indirect heat exchange with vaporizing liquid from the bottom of the stripping column, thereby providing boilup vapor for the stripping column.

In a further embodiment of the invention, the vaporized stripper bottoms stream is compressed, cooled, and reliquefied to yield a liquid product rich in ethane and heavier hydrocarbons. A first portion of this liquid product rich in ethane and heavier hydrocarbons is introduced into a distillation column and an ethane-rich overhead vapor and a liquid bottoms product rich in propane and heavier hydrocarbons are withdrawn therefrom. A second portion of the liquid product rich in ethane and heavier hydrocarbons is cooled and expanded to a lower pressure, and the resulting expanded liquid is vaporized by indirect heat exchange against vapor from the top of the distillation column, thereby cooling and condensing at least a portion of the vapor to provide liquid reflux for the distillation column. The resulting vapor rich in ethane and heavier hydrocarbons is combined with the vaporized stripper bottoms stream prior to compressing, cooling, and reliquefying to yield the liquid product rich in ethane and heavier hydrocarbons. The ethane-rich overhead vapor is warmed by indirect heat exchange to provide additional cooling for the second portion of the liquid product rich in ethane and heavier hydrocarbons.

Alternatively, the liquid product rich in ethane and heavier hydrocarbons can be introduced into a stripping column to produce an ethane-rich overhead vapor and a liquid bottoms product rich in propane and heavier hydrocarbons. In this case, the separation of ethane from the residual liquid mixture is less effective than when the separation is carried out in a full distillation column, but capital requirement will be lower since the equipment to provide reflux is not required.

Compared with the prior art processes described earlier, the present invention offers reduced capital cost by eliminating the turboexpander and reducing the amount of residual gas which must be recompressed, thereby reducing operating cost.

DETAILED DESCRIPTION OF THE INVENTION

Natural gas liquids are recovered from compressed natural gas according to the present invention without the need for external refrigeration or feed turboexpanders as used in the prior art. Instead, autorefrigeration and integrated heat exchange are combined in an alternative process with reduced capital and operating costs compared with commonly used NGL recovery methods.

Figure 1:
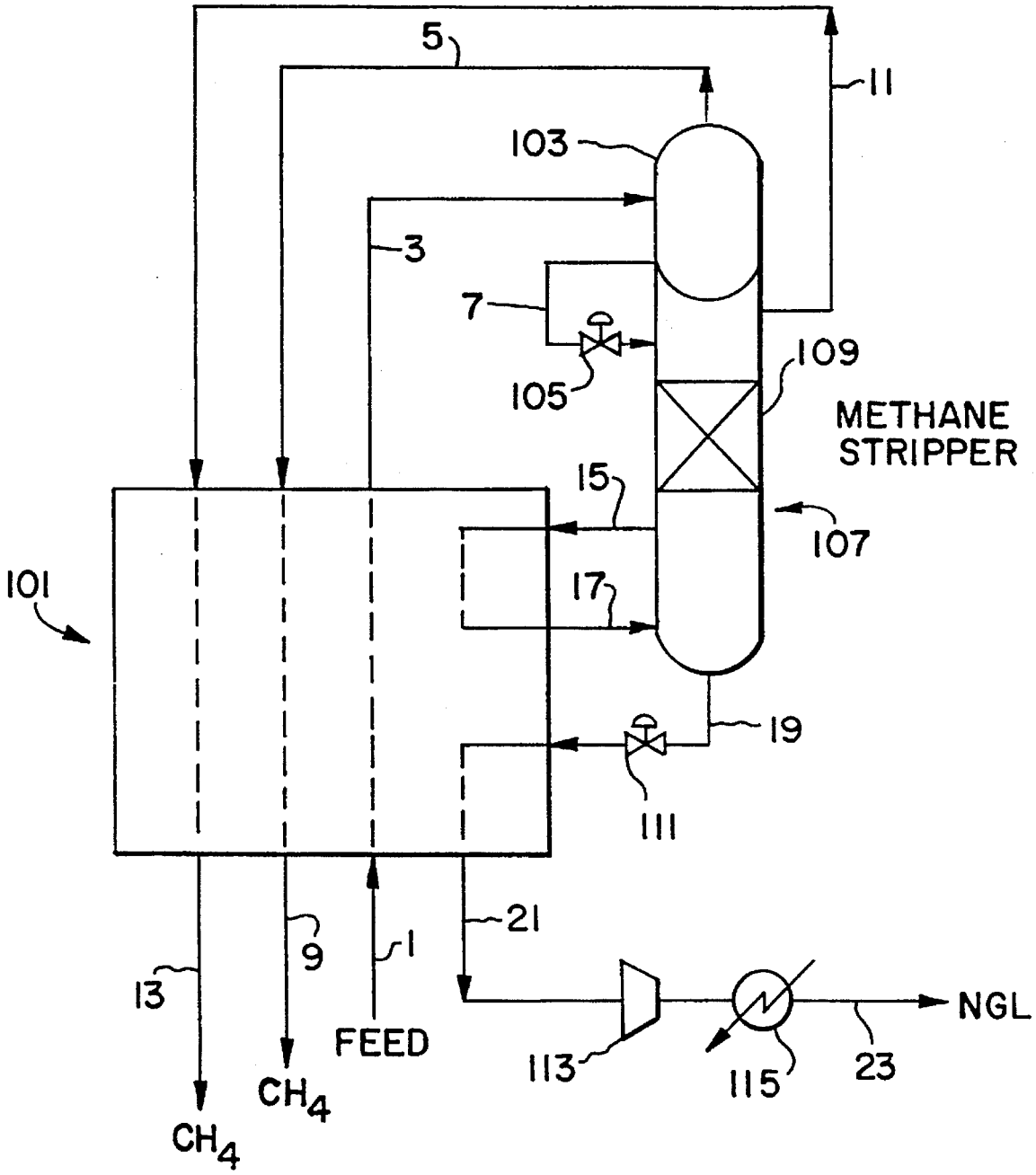
FIG. 1 is a schematic flow diagram of the method of the present invention.

The basic embodiment of the present invention is illustrated in FIG. 1. Compressed natural gas feed 1 is obtained by pretreating raw natural gas using methods known in the art to remove water, acid gases, and other impurities, and typically is provided at ambient temperature and pressures between 200 and 700 psia. This natural gas feed typically contains up to 15 vol % light hydrocarbons, chiefly ethane, propane, and butane with smaller concentrations of $C_5^+$hydrocarbons and nitrogen. Compressed natural gas feed 1 is cooled and partially condensed in heat exchange zone 101 by indirect heat exchange with several cold process streams (which are later defined) to yield partially condensed feed stream 3 at −130° F. to −150° F. Heat exchange zone 101 is a core type plate-fin heat exchanger typically used for this type of service. The partially condensed feed stream is separated into methane-rich vapor 5 and hydrocarbon-rich liquid 7 at near feed pressure. Cold methane-rich vapor 5 provides cooling for feed gas 1 by indirect heat exchange in heat exchange zone 101 and in turn is warmed to near ambient temperature to yield methane product 9. Hydrocarbon-rich liquid 7 is introduced into methane stripper column 107 at or below the pressure of partially condensed feed stream 3. The methane dissolved in the liquid hydrocarbon is stripped by rising hydrocarbon vapor in mass transfer zone 109 to yield cold overhead methane 11 which provides additional cooling for feed gas 1 by indirect heat exchange in heat exchange zone 101, and in turn is warmed to near ambient temperature to yield methane product 13.

Methane stripper column 107 typically operates at a pressure up to 400 psia. If the pressure of partially condensed feed stream 3 is higher than the stripper operating pressure, liquid 7 is flashed or reduced in pressure across expansion valve 105 to the stripper operating pressure, thereby cooling and partially vaporizing the stream. In this case, methane products 9 and 13 are withdrawn at different pressures determined by the pressures of partially condensed feed stream 3 and methane stripper column 107.

Liquid stream 15 from a location below mass transfer zone 109 in methane stripper 107 is vaporized in heat exchange zone 101 to provide a portion of the cooling duty for cooling and condensing natural gas feed 1, and the resulting vapor 17 is returned to provide the stripping vapor flowing upward through stripper 107. Stripper bottoms liquid 19, typically at −50° F. to −100° F., is withdrawn and flashed or reduced in pressure which cools the stream, and the cooled stream is warmed and vaporized in heat exchange zone 101 by indirect heat exchange to provide additional cooling duty for cooling and condensing natural gas feed 1. Vaporized hydrocarbon stream 21 optionally is compressed in compressor 113 and cooled in cooler 115 to yield NGL product 23 at 500–600 psia and near ambient temperature. A typical NGL product contains approximately 40 vol % $C_2$, 40 vol % $C_3$, and 20 vol % $C_4$ and heavier hydrocarbons; actual NGL composition varies with the natural gas source.

Figure 2:
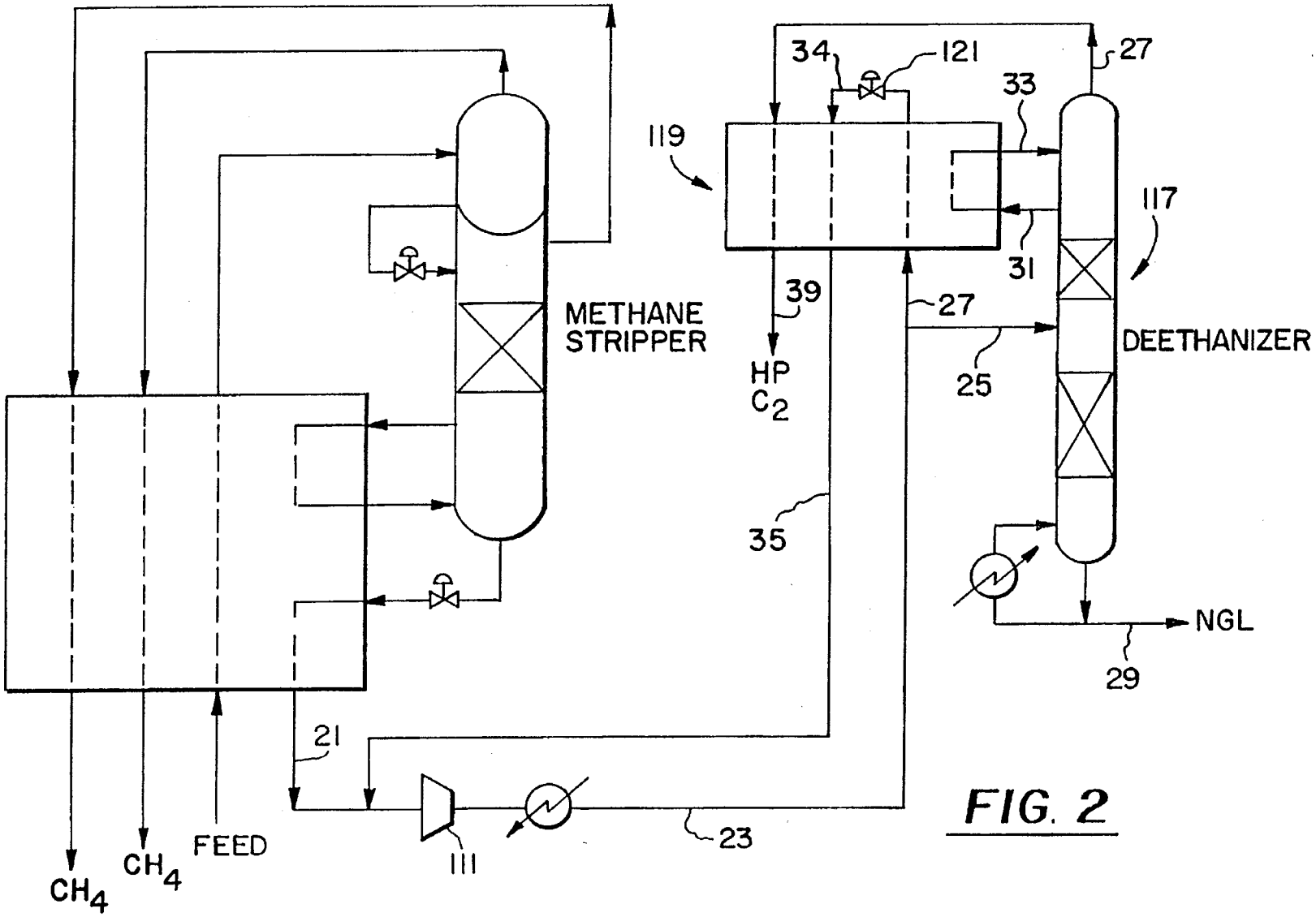
FIG. 2 is schematic flow diagram of an alternative embodiment of the present invention.

An alternative embodiment of the invention is illustrated in FIG. 2 in which NGL product 23 is processed further to recover ethane and a heavier NGL product comprising chiefly propane and heavier hydrocarbons. A portion 25 of NGL product 23 is introduced into deethanizer column 117 which produces cold ethane-rich vapor overhead 27 and heavier NGL bottoms product 29. Reflux for deethanizer 117 is provided by condensing vapor sidestream 31 in heat exchange zone 119 to yield liquid reflux 33. The major portion of the refrigeration for producing reflux 33 is provided by cooling a second portion 27 of NGL product 23 and expanding the cooled stream across expansion valve 121 to 200–500 psia. Expanded and further cooled stream 34, now at −50° F. to −150° F., is vaporized and warmed in heat exchange zone 119 to provide reflux refrigeration and to cool NGL stream 27. The resulting warm vapor 35 is returned to the inlet of compressor 113. Additional cooling is provided by passing cold ethane-rich vapor overhead 27 through heat exchange zone 119 to yield warm high pressure ethane-rich product 39. Heat exchange zone 119 is a core type plate-fin heat exchanger typically used for this type of service.

In an alternative mode of the invention, deethanizer 117 can be operated without reflux, i.e. as a simple stripper, which eliminates the need for heat exchange zone 119 and results in ethane product 39 having a lower purity and gives a slightly lower recovery of NGL product 29.

The NGL recovery process of the present invention differs from prior art NGL recovery processes chiefly because NGL product 21 of FIG. 1 is recovered as a vapor rather than a liquid, and therefore no external refrigeration is required. Refrigeration for NGL recovery in the present invention is provided by expansion and vaporization of condensed feed liquids, preferably the methane stripper bottoms 19 and optionally the methane stripper feed 3, thereby yielding vaporized NGL product 21. Recompression and cooling of the vaporized NGL product optionally can be utilized if a liquid product is required. Because the feed gas is not work expanded, a large fraction of the purified natural gas is recovered at near feed pressure as methane product 9. The remainder of the product methane is recovered at or below feed pressure, and some recompression of this stream may be required depending upon end use of the purified natural gas.

The essential characteristics of the present invention are described completely in the foregoing disclosure. One skilled in the art can understand the invention and make various modifications thereto without departing from the basic spirit thereof, and without departing from the scope of the claims which follow.

We claim:

1. A method for the recovery of hydrocarbons heavier than methane from mixtures of methane and said hydrocarbons which comprises:

(a) cooling and partially liquefying a compressed natural gas feed stream containing methane and said hydrocarbons;

(b) separating the resulting partially condensed feed stream into a methane-rich vapor and a first liquid;

(c) introducing said first liquid into a stripping column which operates at or below the pressure of said partially condensed feed stream;

(d) recovering from said stripping column a methane-rich overhead vapor and a stripper bottoms liquid rich in said hydrocarbons heavier than methane; and (e) expanding said stripper bottoms liquid and vaporizing the resulting expanded stream by indirect heat exchange with said compressed natural gas feed stream, thereby providing at least a portion of the cooling for said compressed natural gas feed stream in step (a) and yielding a vaporized stripper bottoms stream rich in said hydrocarbons heavier than methane.

2. The method of claim 1 wherein said stripping column operates below the pressure of said partially condensed feed stream, and wherein said first liquid is expanded and thereby cooled prior to introduction into said stripping column.

3. The method of claim 1 wherein another portion of the cooling of said compressed natural gas feed stream in step (a) is provided by indirect heat exchange with vaporizing liquid from the bottom of said stripping column, thereby providing boilup vapor for said stripping column.

4. The method of claim 1 wherein another portion of the cooling of said compressed natural gas feed stream is provided by indirect heat exchange with said methane-rich vapor of step (b).

5. The method of claim 1 wherein another portion of the cooling of said compressed natural gas feed stream is provided by indirect heat exchange with said methane-rich overhead vapor of step (d).

6. The method of claim 1 which further comprises compressing, cooling, and reliquefying said vaporized stripper bottoms stream to yield a liquid rich in ethane and heavier hydrocarbons.

7. The method of claim 6 which further comprises introducing a first portion of said liquid rich in ethane and heavier hydrocarbons into a distillation column and withdrawing therefrom an ethane-rich overhead vapor and a liquid bottoms product rich in propane and heavier hydrocarbons.

8. The method of claim 7 which further comprises cooling a second portion of said liquid rich in ethane and heavier hydrocarbons, expanding the resulting cooled liquid to a lower pressure, and vaporizing the resulting expanded liquid by indirect heat exchange against vapor from the top of said distillation column, thereby cooling and condensing at least a portion of said vapor to provide liquid reflux for said distillation column and yielding a warm vapor rich in ethane and heavier hydrocarbons.

9. The method of claim 8 which further comprises combining said warm vapor rich in ethane and heavier hydrocarbons with said vaporized stripper bottoms stream, and compressing, cooling, and reliquefying the resulting combined stream to yield said liquid rich in ethane and heavier hydrocarbons.

10. The method of claim 8 which comprises warming said ethane-rich overhead vapor by indirect heat exchange to provide additional cooling for said second portion of liquid rich in ethane and heavier hydrocarbons.

11. The method of claim 6 which further comprises introducing said liquid rich in ethane and heavier hydrocarbons into a stripping column and withdrawing therefrom an ethane-rich overhead vapor and a liquid bottoms product rich in propane and heavier hydrocarbons.

* * * * *